US009299351B2

(12) United States Patent
Kim et al.

(10) Patent No.: US 9,299,351 B2
(45) Date of Patent: Mar. 29, 2016

(54) METHOD AND APPARATUS OF SUPPRESSING VOCODER NOISE

(71) Applicant: Samsung Electronics Co. Ltd., Suwon-si, Gyeonggi-do (KR)

(72) Inventors: Won-Cheol Kim, Seoul (KR); Joon-Sang Ryu, Suwon-si (KR); Tae-Kyun Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 217 days.

(21) Appl. No.: 13/963,342

(22) Filed: Aug. 9, 2013

(65) Prior Publication Data

US 2014/0257801 A1 Sep. 11, 2014

(30) Foreign Application Priority Data

Mar. 11, 2013 (KR) ..... 10-2013-0025679

(51) Int. Cl.

| | |
|---|---|
| ***G10L 21/00*** | (2013.01) |
| ***G10L 21/02*** | (2013.01) |
| ***G10L 19/005*** | (2013.01) |
| *G10L 21/0316* | (2013.01) |
| *G10L 21/0232* | (2013.01) |

(52) U.S. Cl.

CPC ..... *G10L 19/005* (2013.01); *G10L 21/0232* (2013.01); *G10L 21/0316* (2013.01)

(58) Field of Classification Search

USPC ..... 704/200–232, 500–504

See application file for complete search history.

(56) References Cited

U.S. PATENT DOCUMENTS

| | | | | |
|---|---|---|---|---|
| 5,978,824 | A * | 11/1999 | Ikeda | 708/322 |
| 6,578,162 | B1 * | 6/2003 | Yung | 714/708 |
| 2004/0066940 | A1 * | 4/2004 | Amir | 381/94.2 |
| 2004/0205438 | A1 | 10/2004 | Chien et al. | |
| 2005/0288923 | A1 * | 12/2005 | Kok | 704/226 |
| 2006/0100868 | A1 * | 5/2006 | Hetherington et al. | 704/226 |
| 2006/0136203 | A1 * | 6/2006 | Ichikawa | 704/226 |
| 2007/0058822 | A1 * | 3/2007 | Ozawa | 381/94.1 |
| 2009/0281797 | A1 | 11/2009 | Zopf et al. | |

* cited by examiner

*Primary Examiner* — Jesse Pullias

(74) *Attorney, Agent, or Firm* — Jefferson IP Law, LLP

(57) ABSTRACT

A method and apparatus of suppressing a vocoder noise are provided. The method includes receiving from a channel decoder a vocoder frame and first information, the first information indicating whether the vocoder frame has an error, generating speech data by performing voice decoding on the vocoder frame, determining whether a tonal noise has been detected in the speech data, if the first information indicates that the vocoder frame has an error, and attenuating the volume of the speech data and outputting the volume-attenuated speech data through a speaker, upon detection of the tonal noise in the speech data.

16 Claims, 4 Drawing Sheets

METHOD AND APPARATUS OF SUPPRESSING VOCODER NOISE

PRIORITY

This application claims the benefit under 35 U.S.C. §119 (a) of a Korean patent application filed on Mar. 11, 2013 in the Korean Intellectual Property Office and assigned Serial No. 10-2013-0025679, the entire disclosure of which is hereby incorporated by reference.

BACKGROUND OF THE INVENTION

1. Field of the Invention

The present invention relates to voice decoding. More particularly, the present invention relates to a method and apparatus of suppressing a voice noise in a voice decoder.

2. Description of the Related Art

A vocoder including both a voice coder and a voice decoder is configured to transmit data including parameters generated by analyzing characteristics of a voice signal and to synthesize speech based on parameters of received data.

Data transmitted over a communication network, particularly a wireless communication network that transmits and receives signals on radio channels or an Internet Protocol (IP) network, may be received with transmission errors due to a radio propagation environment. Therefore, a vocoder used for mobile communication generally has a speech synthesizing function that makes a transmission/reception error environment unperceivable to a user.

In a poor wireless environment, the probability of generating a false alarm may be increased during decoding at a channel decoder. When a bad frame is mistakenly generated for a good frame or vice versa due to a channel decoding error, the false alarm may be generated. Particularly when a bad frame is mistakenly generated for a good frame, the vocoder may synthesize speech using the data of the bad frame or perform an unnecessary error correction operation on a good frame. Accordingly, if a channel decoder does not have sufficiently good decoding performance, a bad frame may cause a tonal noise.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide a method and apparatus of suppressing a vocoder noise in a poor wireless environment.

Another aspect of the present invention is to provide a method and apparatus of compensating the voice quality of synthesized speech, when a channel decoder has a decoding error.

Another aspect of the present invention is to provide a method and apparatus of preventing generation of a false alarm in a channel decoder.

Another aspect of the present invention is to provide a method and apparatus of controlling sound volume by rapidly detecting generation of a tonal noise in a vocoder.

In accordance with an aspect of the present invention, a method of suppressing a vocoder noise is provided. The method includes receiving from a channel decoder a vocoder frame and first information, the first information indicating whether the vocoder frame has an error, generating speech data by performing voice decoding on the vocoder frame, determining whether a tonal noise has been detected in the speech data, if the first information indicates that the vocoder frame has an error, and attenuating the volume of the speech data and outputting the volume-attenuated speech data through a speaker, upon detection of the tonal noise in the speech data.

In accordance with another aspect of the present invention, an apparatus of suppressing a vocoder noise is provided. The apparatus includes a voice decoder configured to receive from a channel decoder a vocoder frame and first information, the first information indicating whether the vocoder frame has an error and to generate speech data by performing voice decoding on the vocoder frame, a tonal noise detector configured to determine whether a tonal noise has been detected in the speech data, if the first information indicates that the vocoder frame has an error, and a volume controller configured to attenuate the volume of the speech data and output the volume-attenuated speech data through a speaker, upon detection of the tonal noise in the speech data.

In accordance with another aspect of the present invention, a method of suppressing a vocoder noise is provided. The method includes receiving from a channel decoder a vocoder frame and first information, the first information indicating whether the vocoder frame has an error, generating first speech data by performing voice decoding on the vocoder frame, generating second speech data by performing voice decoding on a next frame, considering that the next frame is a bad frame, if the first information indicates that the vocoder frame has an error, determining whether a tonal noise has been detected in the first and second speech data, and attenuating the volume of the first speech data and outputting the volume-attenuated first speech data through a speaker, upon detection of the tonal noise in the first and second speech data.

In accordance with another aspect of the present invention, an apparatus of suppressing a vocoder noise is provided. The apparatus includes a first voice decoder configured to receive from a channel decoder a vocoder frame and first information, the first information indicating whether the vocoder frame has an error and to generate first speech data by performing voice decoding on the vocoder frame, a second voice decoder configured to generate second speech data by performing voice decoding on a next frame, considering that the next frame is a bad frame, if the first information indicates that the vocoder frame has an error, a tonal noise detector configured to determine whether a tonal noise has been detected in the first and second speech data, and a volume controller configured to attenuate the volume of the first speech data and output the volume-attenuated first speech data through a speaker, upon detection of the tonal noise in the first and second speech data.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and/or other aspects, features, and advantages of certain exemplary embodiments of the present invention will be more apparent from the following description taken in conjunction with the accompanying drawings, in which.

Throughout the drawings, like reference numerals will be understood to refer to like parts, components, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. The description includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Exemplary embodiments of the present invention will be provided to achieve the above-described technical aspects of the present invention. In an exemplary implementation, defined entities may have the same names, to which the present invention is not limited. Thus, exemplary embodiments of the present invention can be implemented with same or ready modifications in a system having a similar technical background.

Figure 1:
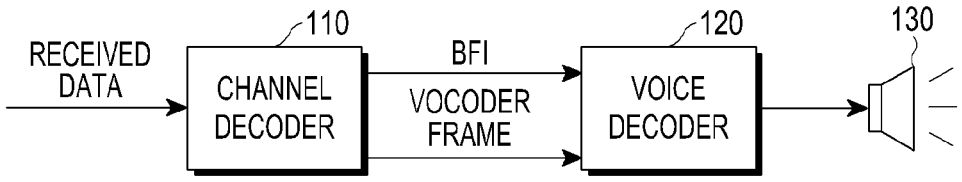
FIG. 1 is a block diagram of an apparatus of suppressing a vocoder noise according to an exemplary embodiment of the present invention.

FIG. 1 is a block diagram of an apparatus of suppressing a vocoder noise according to an exemplary embodiment of the present invention.

Referring to FIG. 1, a channel decoder 110 receives data on a channel. The format of the received data may vary depending on a used communication scheme and a system configuration. For example, in wireless communication, the channel decoder 110 may receive data through a Radio Frequency (RF) unit that receives the data from a transmitter (not shown) and a demodulator that demodulates the data.

The channel decoder 110 channel-decodes the received data. Specifically, the channel decoder 110 generates a vocoder frame by decoding the received data using a decoding algorithm corresponding to an encoding algorithm of the transmitter, checks a Cyclic Redundancy Check (CRC) of the data, and outputs a Bad Frame Indicator (BFI). That is, a CRC check result indicates whether the data has an error. A vocoder frame may be 20 ms long for use in a general vocoder.

A voice decoder 120 receives the vocoder frame and the BFI. If the BFI is Good ('0'), the voice decoder 120 generates speech data including Pulse Code Modulation (PCM) data by decoding the vocoder frame by normal voice decoding. The voice decoder 120 includes an Error Concealment Unit (ECU) block (not shown) that operates upon the generation of an error in the received data. The voice decoder 120 determines whether to activate the ECU block based on the BFI. If the BFI is Bad ('1'), the voice decoder 120 activates the ECU block to perform voice decoding on a bad frame. The ECU block increases perceivable sound quality by repeating the speech data of a previous frame or interpolating between a current frame and a previous frame. Specifically, the voice decoder 120 reuses the speech data of a previous frame with good quality or generates new speech data by interpolating between speech data with good quality and speech data with poor quality.

A Digital to Analog Converter (DAC) (not shown) converts the speech data received from the voice decoder 120 to an analog signal and outputs the analog signal through a speaker 130.

If a normal ECU operation is not possible due to a decoding error of the channel decoder 110 in a poor wireless environment, an exemplary embodiment of the present invention provides a method of compensating the voice quality of synthesized speech. If the channel decoder 110 mistakes received bad data for good data, the voice decoder 120 generates speech data by a speech synthesizing scheme intended for good data. Since a packet error generated in a weak-field environment generally contains bursts, a channel decoding error causes degradation of the voice quality of synthesized speech. If errors are generated successively and initial error data is determined as normal data, noise audio signals may be generated successively across a plurality of frames according to a subsequent ECU operation.

If successive bad frames are generated during utterance of voiced sound in a call, a tonal noise is created. Specifically, if a bad frame is mistakenly generated for a good frame due to a channel decoding error, abnormal sound is generated because of an abnormal waveform caused by decoding of the bad frame in the voice decoder. Then when bad frames are generated successively, the abnormal noise lasts for a predetermined time due to an ECU operation, thereby causing user inconvenience.

The tonal noise refers to a noise in the form of a peak observed in a voice spectrum. Particularly when previously uttered speech is loud, the tonal noise generated in a weak field is very irritating and thus needs to be eliminated or removed.

In an exemplary embodiment of the present invention which will be described below, generation of the tonal noise is rapidly monitored and upon generation of the tonal noise, the sound volume of speech data output from a voice decoder is rapidly decreased, thereby preventing an abnormal sound which may irritate a user.

Figure 2:
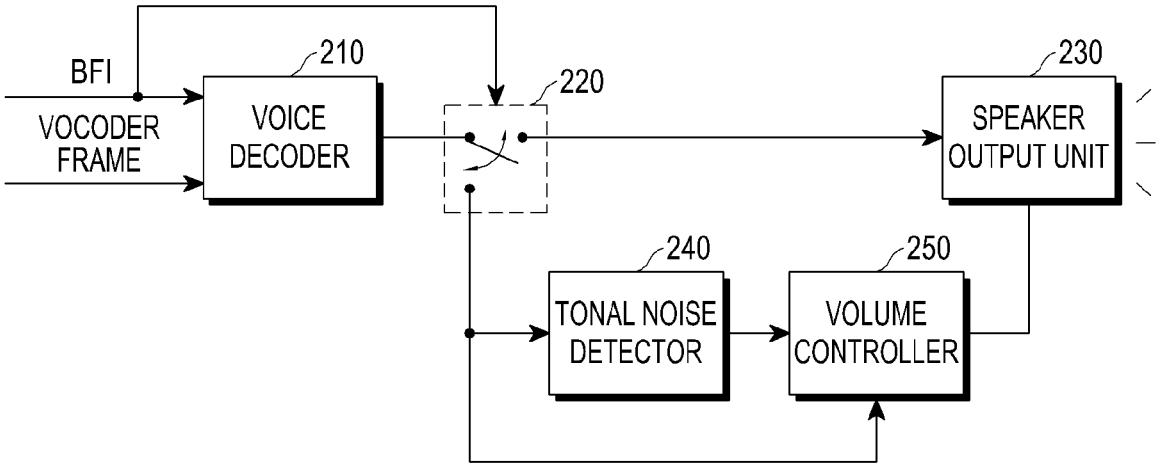
FIG. 2 is a block diagram of an apparatus of suppressing a vocoder noise according to another exemplary embodiment of the present invention.

FIG. 2 is a block diagram of an apparatus of suppressing a vocoder noise according to another exemplary embodiment of the present invention.

Referring to FIG. 2, a voice decoder 210 receives a vocoder frame and a BFI indicating whether the vocoder frame has an error from a channel decoder (not shown). The voice decoder 210 generates speech data by performing voice decoding on the vocoder frame. In an exemplary embodiment, if the BFI is Good ('0'), the voice decoder 210 processes the vocoder frame by normal voice decoding. If the BFI is Bad ('1'), the voice decoder 210 processes the vocoder frame by a known ECU function. Specifically, the voice decoder 210 outputs the speech data of a previous frame in a current frame, while deleting a current bad vocoder frame, or generates new speech data by interpolating the speech data of the current frame with the speech data of a previous frame according to the ECU function.

The output of the voice decoder 210 is provided to a speaker output unit 230 through a switch 220. The switch 220 operates according to the BFI received from the voice decoder 210. If the BFI is '0' indicating a normal frame, the switch 220 switches the speech data received from the voice decoder 210 to the speaker output unit 230. A DAC of the speaker output unit 230 converts the received speech data to an analog signal and outputs the analog signal as sound audible to the user.

Alternatively, if the BFI is '1' indicating a bad frame, the switch 220 switches the bad speech data received from the voice decoder to a signal path set for volume control. The signal path includes a tonal noise detector 240 and a volume controller 250.

The tonal noise detector 240 determines whether there is a peak tone in the voice spectrum of the speech data received from the switch 220 by analyzing the voice spectrum. The peak tone acts as a tonal noise when it is output through a speaker. Upon detection of the tonal noise in the speech data, the tonal noise detector 240 provides a tone detection flag indicating the detection of the tonal noise to the volume controller 250. The volume controller 250 attenuates the volume of the speech data received from the switch 220 in response to reception of the tone detection flag and provides the volume-controlled speech data to the speaker output unit 230. If the tone detection flag indicates non-detection of the tonal noise, the volume controller 250 outputs the received speech data to the speaker output unit 230 without controlling the volume of the speech data.

The degree of volume control, particularly the degree of volume attenuation in the volume controller 250 may be set to a predetermined value in an exemplary embodiment of the present invention. In another exemplary embodiment, the degree of volume attenuation may be increased according to the number of tonal noise detections. Specifically, the degree of volume attenuation may be set to V1 for a first frame in which a tonal noise is detected and then may be set to V1×N according to the number N of frames in which tonal noise is detected contiguously or non-contiguously.

If a bad frame is generated and includes a tonal noise, the above-described structure may rapidly attenuate the volume of sound output through a speaker, thereby preventing abnormal sound which may irritate a user.

Figure 3:
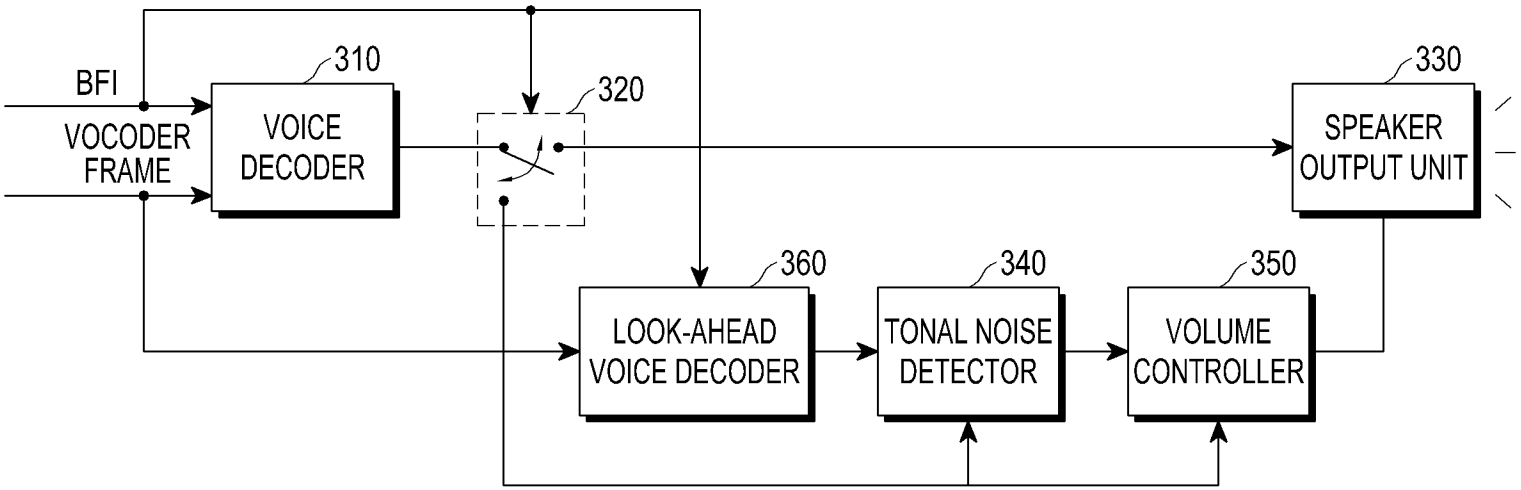
FIG. 3 is a block diagram of an apparatus of suppressing a vocoder noise according to another exemplary embodiment of the present invention.

FIG. 3 is a block diagram of an apparatus of suppressing a vocoder noise according to another exemplary embodiment of the present invention.

Referring to FIG. 3, a voice decoder 310 receives a vocoder frame and a BFI indicating whether the vocoder frame has an error from a channel decoder (not shown). The voice decoder 310 generates speech data by performing voice decoding on the vocoder frame. In an exemplary embodiment, if the BFI is Good ('0'), the voice decoder 310 processes the vocoder frame by normal voice decoding. If the BFI is Bad ('1'), the voice decoder 310 processes the vocoder frame by a known ECU function. Specifically, the voice decoder 310 outputs the speech data of a previous frame in a current frame, while deleting a current bad vocoder frame, or generates new speech data by interpolating the speech data of the current frame with the speech data of a previous frame according to the ECU function.

The output of the voice decoder 310 is provided to a speaker output unit 330 through a switch 320. The switch 320 operates according to the BFI received from the voice decoder 310. If the BFI is '0' indicating a normal frame, the switch 320 switches the speech data received from the voice decoder 310 to the speaker output unit 330. A DAC of the speaker output unit 330 converts the received speech data to an analog signal and outputs the analog signal as sound audible to the user.

Alternatively, if the BFI is '1' indicating a bad frame, the switch 320 switches the bad speech data received from the voice decoder 310 to a signal path set for volume control. The signal path includes a tonal noise detector 340 and a volume controller 350.

The tonal noise detector 340 detects tones in the speech data received from the switch 320 and in predicted speech data for a next frame. A look-ahead voice decoder 360 generates the predicted data of the next frame. The look-ahead voice decoder 360 implements the same decoding algorithm as used in the voice decoder 310 and operates as follows.

The look-ahead voice decoder 360 receives a vocoder frame including speech packet data like the voice decoder 310 and is controlled by a BFI. Specifically, if the BFI is '0' indicating that a current frame is normal, the look-ahead voice decoder 360 stores speech-related parameters of the received current vocoder frame. If the BFI is '1' indicating that the current frame is bad, the look-ahead voice decoder 360 performs voice decoding on the next frame based on pre-stored speech-related parameters of a normal frame and the speech data of the current frame, considering that the next frame is a bad frame. Predicted speech data for the next frame is provided to the tonal noise detector 340.

The tonal noise detector 340 determines the presence or absence of a peak tone in the voice spectrums of the speech data of the current bad frame received from the switch 320 and the voice spectrum of the predicted speech data of the next frame received from the look-ahead voice decoder 360 by analyzing the voice spectrums. The peak tone acts as a tonal noise when it is output through a speaker. Upon detection of the tonal noise in the speech data of the current frame and the predicted speech data of the next frame, the tonal noise detector 340 provides a tone detection flag indicating the detection of the tonal noise to the volume controller 350. The volume controller 350 controls, particularly attenuates the volume of the speech data received from the switch 320 in response to reception of the tone detection flag and provides the volume-controlled speech data to the speaker output unit 330.

The degree of volume control, particularly the degree of volume attenuation in the volume controller 350 may be set to a predetermined value in an exemplary embodiment of the present invention. In another exemplary embodiment, the degree of volume attenuation may be increased according to the number of tonal noise detections. Specifically, the degree of volume attenuation may be set to V1 for a first frame in which a tonal noise is detected and then may be set to V1×N according to the number N of frames in which the tonal noise is detected contiguously or non-contiguously.

If the tone detection flag indicates non-detection of a tonal noise, the volume controller 350 outputs the received speech data to the speaker output unit 330 without controlling the volume of the speech data.

If a BFI is set, the above-described structure may determine the presence of the tonal noise in a next successive bad frame by pre-processing the next bad frame, thereby rapidly performing volume control of the tonal noise.

Figure 4:
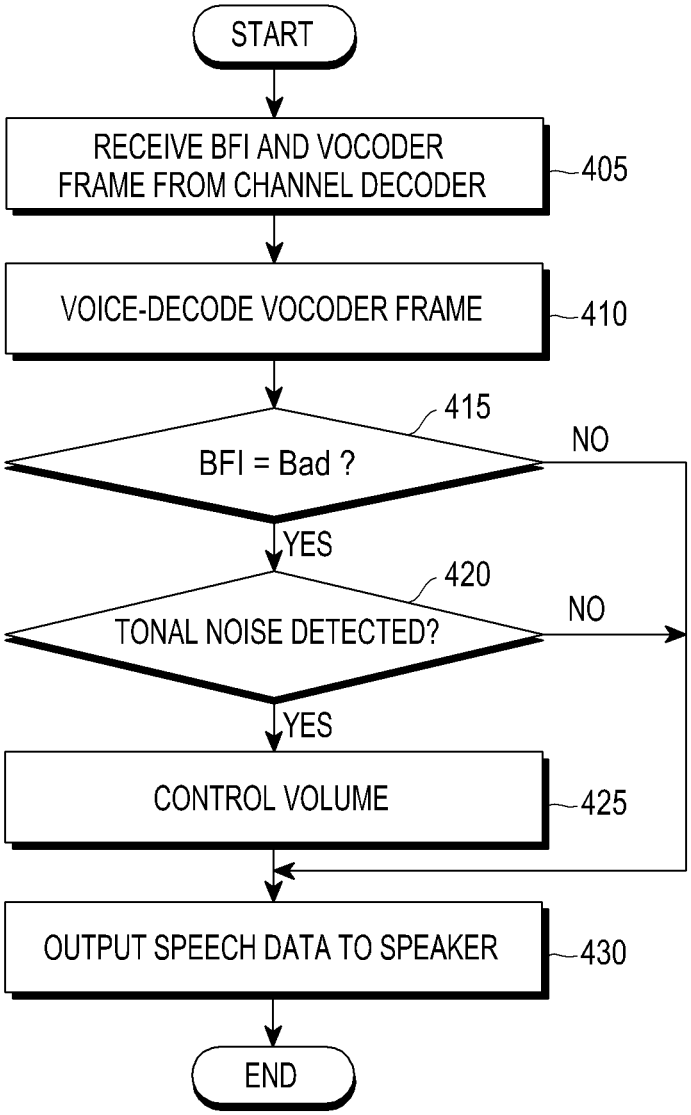
FIG. 4 is a flowchart illustrating an operation of suppressing a vocoder noise according to an exemplary embodiment of the present invention.

FIG. 4 is a flowchart illustrating an operation of suppressing a vocoder noise according to an exemplary embodiment of the present invention.

Referring to FIG. 4, the voice decoder receives a BFI and a vocoder frame from the channel decoder in step 405 and generates speech data by performing voice decoding on the vocoder frame in step 410. In step 415, the apparatus determines whether the BFI is Bad ('1'). If the BFI is not Bad ('1) or in other words if the BFI is Good ('0'), i.e., no in step 415, the speech data generated from the voice decoder is output through the speaker in step 430. Aside from volume control in the apparatus itself, an additional volume control based on the quality of the vocoder frame is not performed in step 430.

On the other hand, if the BFI is Bad ('1'), i.e., yes at step 415, the apparatus determines whether a tonal noise taking the form of a peak has been detected in the speech data generated from the voice decoder in step 420. If the tonal noise has not been detected, i.e., no at step 420, the speech data is output through the speaker in step 430. Alternatively, upon detection of a tonal noise, i.e., yes at step 420, the apparatus attenuates the volume of the speech data in step 425 and outputs the volume-attenuated speech data in step 430.

Figure 5:
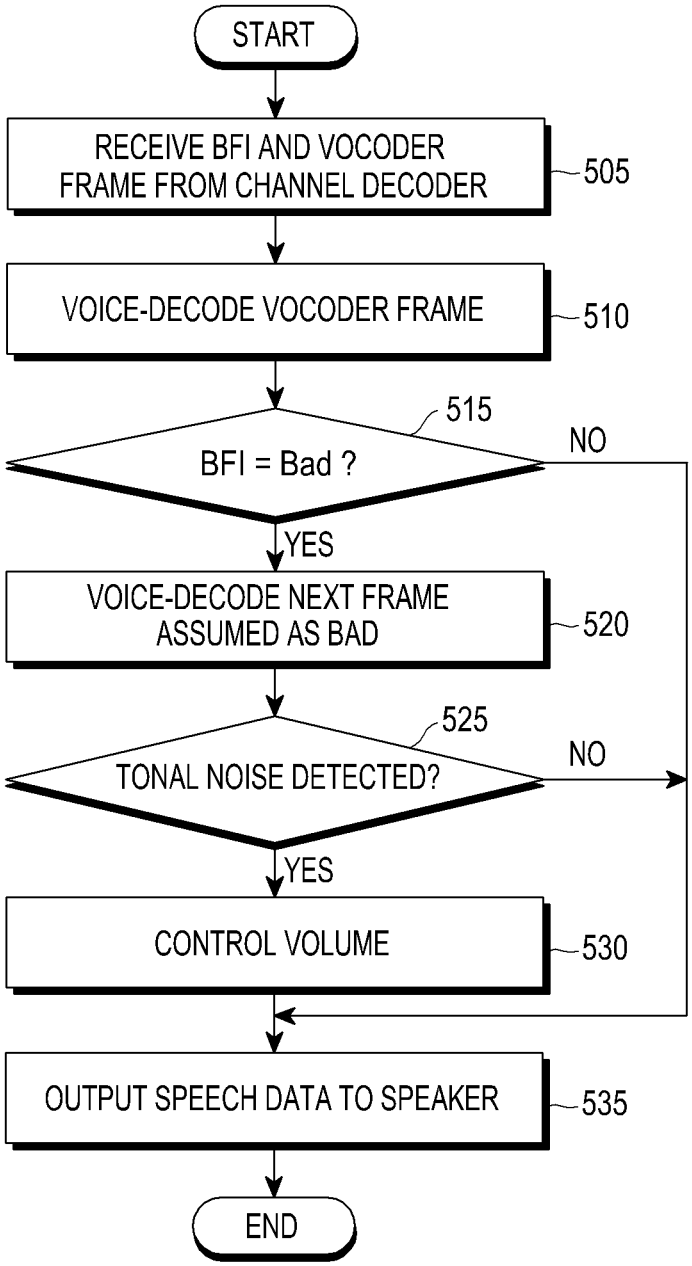
FIG. 5 is a flowchart illustrating an operation of suppressing a vocoder noise according to another exemplary embodiment of the present invention.

FIG. 5 is a flowchart illustrating an operation of suppressing a vocoder noise according to another exemplary embodiment of the present invention.

Referring to FIG. 5, the voice decoder receives a BFI and a vocoder frame from the channel decoder in step 505 and generates speech data by performing voice decoding on the vocoder frame in step 510. In step 515, the apparatus determines whether the BFI is Bad ('1"). If the BFI is not Bad ('1) or in other words if the BFI is Good ('0'), i.e., no at step 515, the speech data generated from the voice decoder is output through the speaker in step 535. Aside from volume control in the apparatus itself, an additional volume control based on the quality of the vocoder frame is not performed in step 535.

On the other hand, if the BFI is Bad ('1'), i.e., yes at step 515, the look-ahead voice decoder generates predicted speech data for a next frame by performing voice decoding on the next frame based on a pre-stored normal frame and the current frame, considering that the next frame is a bad frame in step 520.

The apparatus determines whether the tonal noise taking the form of a peak has been detected in the speech data generated from the voice decoder and in the predicted speech data of the next frame in step 525. If the tonal noise has not been detected, i.e., no at step 525, the speech data is output through the speaker in step 535. Alternatively, upon detection of a tonal noise, i.e., yes at step 525, the apparatus attenuates the volume of the speech data of the current frame in step 530 and outputs the volume-attenuated speech data in step 535.

As is apparent from the above description of the exemplary embodiments of the present invention, when bad frames are generated successively, noise generation is rapidly monitored and upon generation of noise, the volume of speech data is controlled so that a user may not perceive the noise.

While the aspects of the invention have been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A method of suppressing a vocoder noise, the method comprising:

receiving from a channel decoder a vocoder frame and first information, the first information indicating whether the vocoder frame has an error;

generating speech data by performing voice-decoding on the vocoder frame to generate speech data;

determining whether a tonal noise has been detected on the speech data, if the first information indicates that the vocoder frame has an error;

reducing a volume of the speech data upon detection of the tonal noise on the speech data; and outputting the volume-reduced speech data to a speaker, wherein the determining comprises detecting the tonal noise on the speech data of the vocoder frame and a predicted speech data of a next vocoder frame by considering that the next vocoder frame is a bad frame.

2. The method of claim 1, wherein the first information is a Bad Frame Indicator (BFI) generated by checking a Cyclic Redundancy Check (CRC) of a channel decoding result of data received on the channel decoder.

3. The method of claim 1, wherein the determination comprises determining whether there is a peak tone in the speech data.

4. An apparatus of suppressing a vocoder noise, the apparatus comprising:

a voice decoder configured to:

receive from a channel decoder a vocoder frame and first information, the first information indicating whether the vocoder frame has an error, and voice-decode the vocoder frame to generate speech data;

a tonal noise detector configured to determine whether a tonal noise has been detected on the speech data if the first information indicates that the vocoder frame has an error; and a volume controller configured to:

reduce a volume of the speech data upon detection of the tonal noise on the speech data, and output the volume-reduced speech data to a speaker, wherein the tonal noise detector is further configured to detect the tonal noise on the speech data of the vocoder frame and a predicted speech data of a next vocoder frame by considering that the next vocoder frame is a bad frame.

5. The apparatus of claim 4, wherein the first information is a Bad Frame Indicator (BFI) generated by checking a Cyclic Redundancy Check (CRC) of a channel decoding result of data received on the channel decoder.

6. The apparatus of claim 4, wherein the tonal noise detector is further configured to determine whether there is a peak tone in the speech data.

7. A method of suppressing a vocoder noise, the method comprising:

receiving from a channel decoder a vocoder frame and first information, the first information indicating whether the vocoder frame has an error;

generating first speech data by performing voice-decoding on the vocoder frame;

generating second speech data by performing voice-decoding on a next vocoder frame where the next vocoder frame is set to a bad frame to predict the second speech data of the next vocoder frame, if the first information indicates that the vocoder frame has an error;

determining whether a tonal noise has been detected on the first speech data and the predicted second speech data;

reducing a volume of the first speech data upon detection of the tonal noise; and outputting the volume-reduced first speech data to a speaker, wherein the determining comprises detecting the tonal noise on the first speech data of the vocoder frame and the predicted second speech data of the next vocoder frame.

8. The method of claim 7, wherein the first information is a Bad Frame Indicator (BFI) generated by checking a Cyclic Redundancy Check (CRC) of a channel decoding result of data received on the channel decoder.

9. The method of claim 7, wherein the determining further comprises determining whether there is a peak tone in the first speech data and the predicted second speech data.

10. The method of claim 7, wherein the vocoder frame is stored when the first information indicates that the vocoder frame does not have an error.

11. The method of claim 10, wherein the performing of the voice-decoding on the next vocoder frame is based on the stored vocoder frame.

12. An apparatus of suppressing a vocoder noise, the apparatus comprising:

a first voice decoder configured to:

receive from a channel decoder a vocoder frame and first information, the first information indicating whether the vocoder frame has an error, and generate first speech data by performing voice-decoding on the vocoder frame;

a second voice decoder configured to voice-decode on a next vocoder frame where the next vocoder frame is set to a bad frame to predict second speech data of the next vocoder frame, if the first information indicates that the vocoder frame has an error;

a tonal noise detector configured to determine whether a tonal noise has been detected on the first speech data and the predicted second speech data; and a volume controller configured to:

reduce a volume of the first speech data upon detection of the tonal noise on the first speech data and the predicted second speech data, and output the volume-reduced first speech data to a speaker, wherein the tonal noise detector is further configured to detect the tonal noise on the first speech data of the vocoder frame and the predicted second speech data of the next vocoder frame.

13. The apparatus of claim 12, wherein the first information is a Bad Frame Indicator (BFI) generated by checking a Cyclic Redundancy Check (CRC) of a channel decoding result of data received on the channel decoder.

14. The apparatus of claim 12, wherein the tonal noise detector is further configured to determine whether there is a peak tone in the first speech data and the predicted second speech data.

15. The apparatus of claim 12, wherein the second voice decoder is further configured to receive and store the vocoder frame when the first information indicates that the vocoder frame does not have an error.

16. The apparatus of claim 15, wherein the second voice decoder is further configured to perform the voice-decoding on the next frame based on the stored vocoder frame.

* * * * *